US011578915B2

(12) United States Patent
Anguiano et al.

(10) Patent No.: US 11,578,915 B2
(45) Date of Patent: Feb. 14, 2023

(54) HYDROCARBON GAS PROCESSING

(71) Applicant: UOP LLC, Des Plaines, IL (US)

(72) Inventors: J. Ascencio Anguiano, Midland, TX (US); John D. Wilkinson, Midland, TX (US); Hank M. Hudson, Midland, TX (US)

(73) Assignee: UOP LLC, Des Plaines, IL (US)

( * ) Notice: Subject to any disclaimer, the term of this patent is extended or adjusted under 35 U.S.C. 154(b) by 224 days.

(21) Appl. No.: 16/815,829

(22) Filed: Mar. 11, 2020

(65) Prior Publication Data

US 2020/0292230 A1 Sep. 17, 2020

Related U.S. Application Data

(60) Provisional application No. 62/816,711, filed on Mar. 11, 2019.

(51) Int. Cl.
*F25J 3/02* (2006.01)

(52) U.S. Cl.
CPC ..... *F25J 3/0242* (2013.01); *F25J 3/0209* (2013.01); *F25J 3/0219* (2013.01); *F25J 3/0238* (2013.01); *F25J 2215/04* (2013.01); *F25J 2240/40* (2013.01); *F25J 2245/02* (2013.01)

(58) Field of Classification Search
CPC ..... F25J 3/0242; F25J 3/0209; F25J 3/0219; F25J 3/0238; F25J 2215/04; F25J 2240/40; F25J 2245/02
See application file for complete search history.

(56) References Cited

U.S. PATENT DOCUMENTS

| | | | |
|---|---|---|---|
| 3,292,380 | A | 12/1966 | Bucklin |
| 4,061,481 | A | 12/1977 | Campbell et al. |
| 4,140,504 | A | 2/1979 | Campell et al. |
| 4,157,904 | A | 6/1979 | Campell et al. |
| 4,171,964 | A | 10/1979 | Campell et al. |
| 4,185,978 | A | 1/1980 | McGalliard et al. |
| 4,251,249 | A | 2/1981 | Gulsby |
| 4,278,457 | A | 7/1981 | Campbell et al. |

(Continued)

OTHER PUBLICATIONS

Mowry, E. Ross, Efficient, High Recovery of Liquids From Natural Gas Utilizing a High Pressure Absorber, Eighty-First Annual Convention Proceedings of Gas Processors Association, 2002.

*Primary Examiner* — Nael N Babaa
(74) *Attorney, Agent, or Firm* — Paschall & Associates, LLC; Mark Goldberg

(57) ABSTRACT

A process and an apparatus are disclosed for the recovery of components from a hydrocarbon gas stream which is divided into first and second streams. The first stream is cooled, expanded to lower pressure, and supplied to a fractionation tower. The second stream is cooled and separated into vapor and liquid streams. The vapor stream is divided into two portions. A first portion is cooled, expanded to tower pressure, and supplied to the tower at an upper mid-column feed position. The second portion and the liquid stream are expanded to tower pressure and supplied to the tower. After heating, compressing, and cooling, a portion of the tower overhead vapor is cooled, expanded, and supplied to the tower at the top feed position. The quantities and temperatures of the feeds to the tower maintain the overhead temperature of the tower whereby the major portion of the desired components is recovered.

12 Claims, 6 Drawing Sheets

(56) References Cited

U.S. PATENT DOCUMENTS

Figure 1:
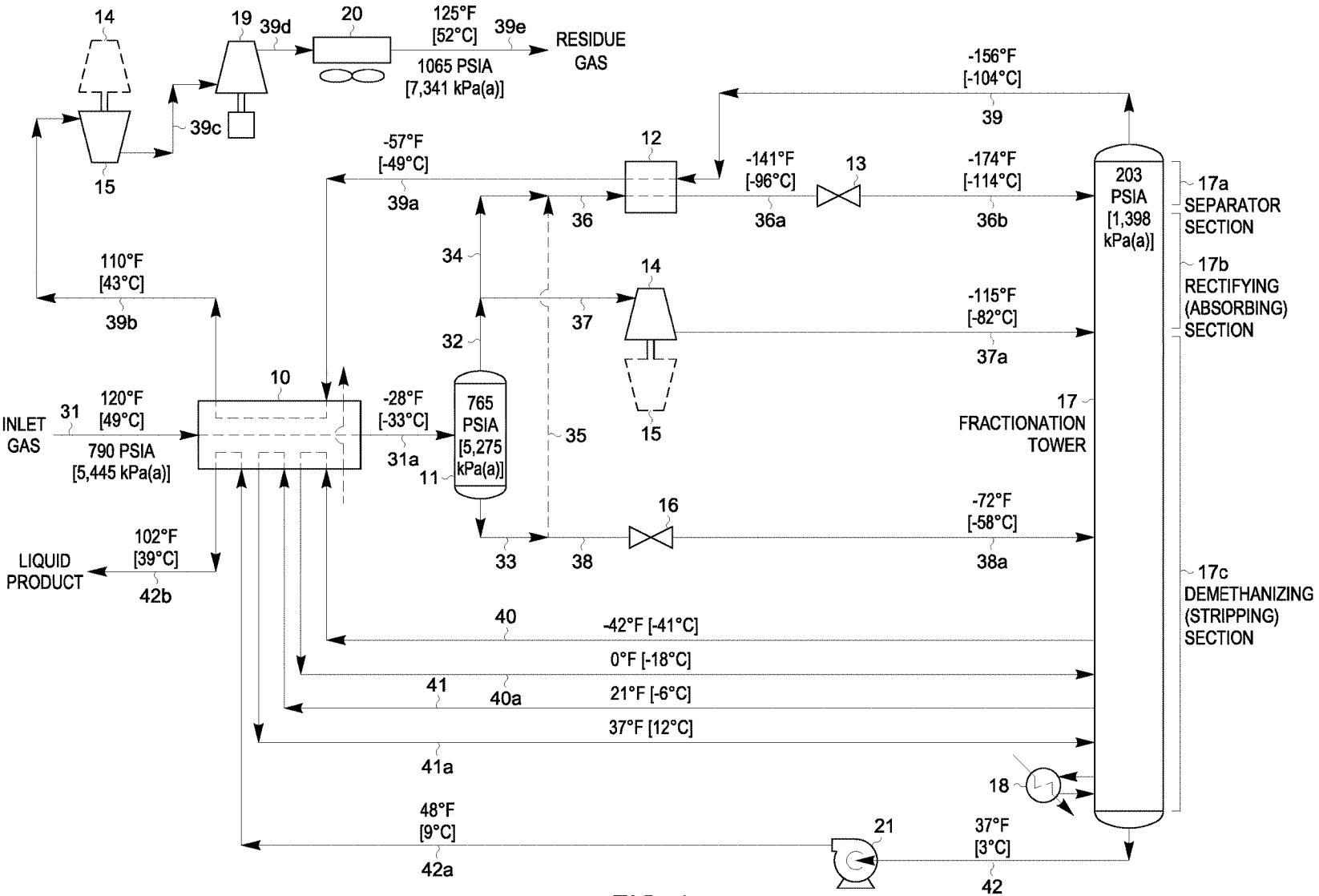
FIG. 1 (PRIOR ART)

| | | | |
|---|---|---|---|
| 4,519,824 | A | 5/1985 | Huebel |
| 4,617,039 | A | 10/1986 | Buck |
| 4,687,499 | A | 8/1987 | Aghill |
| 4,689,063 | A | 8/1987 | Paradowski et al. |
| 4,690,702 | A | 9/1987 | Paradowski et al. |
| 4,854,955 | A | 8/1989 | Campbell et al. |
| 4,869,740 | A | 9/1989 | Campbell et al. |
| 4,889,545 | A | 12/1989 | Campbell et al. |
| RE33,408 | E | 10/1990 | Khan et al. |
| 5,275,005 | A | 1/1994 | Campbell et al. |
| 5,555,748 | A | 9/1996 | Campbell et al. |
| 5,566,554 | A | 10/1996 | Vijayaraghavan et al. |
| 5,568,737 | A | 10/1996 | Campbell et al. |
| 5,771,712 | A | 6/1998 | Campbell et al. |
| 5,799,507 | A | 9/1998 | Wilkinson et al. |
| 5,881,569 | A | 3/1999 | Campbell et al. |
| 5,890,378 | A | 4/1999 | Rambo et al. |
| 5,983,664 | A | 11/1999 | Campbell et al. |
| 6,182,469 | B1 | 2/2001 | Campbell et al. |
| 6,578,379 | B2 | 6/2003 | Paradowski |
| 6,712,880 | B2 | 3/2004 | Foglietta et al. |
| 6,915,662 | B2 | 7/2005 | Wilkinson et al. |
| 7,191,617 | B2 | 3/2007 | Cuellar et al. |
| 7,219,513 | B1 | 5/2007 | Mostafa |
| 8,590,340 | B2 | 11/2013 | Pitman et al. |
| 8,881,549 | B2 | 11/2014 | Johnke et al. |
| 8,919,148 | B2 | 12/2014 | Wilkinson et al. |
| 9,021,831 | B2 | 5/2015 | Johnke et al. |
| 9,021,832 | B2 | 5/2015 | Pierce et al. |
| 9,052,136 | B2 | 6/2015 | Johnke et al. |
| 9,052,137 | B2 | 6/2015 | Johnke et al. |
| 9,057,558 | B2 | 6/2015 | Johnke et al. |
| 9,068,774 | B2 | 6/2015 | Johnke et al. |
| 9,074,814 | B2 | 7/2015 | Johnke et al. |
| 9,080,810 | B2 | 7/2015 | Pitman et al. |
| 9,080,811 | B2 | 7/2015 | Johnke et al. |
| 9,476,639 | B2 | 10/2016 | Martinez et al. |
| 9,637,428 | B2 | 5/2017 | Hudson et al. |
| 9,783,470 | B2 | 10/2017 | Miller et al. |
| 9,927,171 | B2 | 3/2018 | Hudson et al. |
| 9,933,207 | B2 | 4/2018 | Johnke et al. |
| 9,939,195 | B2 | 4/2018 | Johnke et al. |
| 10,227,273 | B2 | 3/2019 | Miller et al. |
| 10,533,794 | B2 | 1/2020 | Lynch et al. |
| 10,551,118 | B2 | 2/2020 | Hudson et al. |
| 10,551,119 | B2 | 2/2020 | Miller et al. |
| 2008/0078205 | A1* | 4/2008 | Cuellar ..... F25J 3/0238 62/620 |
| 2011/0067441 | A1 | 3/2011 | Martinez et al. |
| 2011/0067443 | A1 | 3/2011 | Martinez et al. |
| 2015/0253074 | A1 | 9/2015 | Pitman et al. |
| 2016/0069610 | A1 | 3/2016 | Anguiano et al. |
| 2016/0377341 | A1 | 12/2016 | Martinez et al. |
| 2018/0347898 | A1 | 12/2018 | Pierce et al. |
| 2018/0347899 | A1 | 12/2018 | Cuellar et al. |
| 2019/0170435 | A1 | 6/2019 | Anguiano et al. |

* cited by examiner

HYDROCARBON GAS PROCESSING

This invention relates to a process and apparatus for the separation of a gas containing hydrocarbons. The applicants claim the benefits under Title 35, United States Code, Section 119(e) of prior U.S. Provisional Application No. 62/816,711 which was filed on Mar. 11, 2019.

BACKGROUND OF THE INVENTION

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes, and the like, as well as hydrogen, nitrogen, carbon dioxide, and/or other gases.

The present invention is generally concerned with improving the recovery of ethylene, ethane, propylene, propane, and heavier hydrocarbons from such gas streams. A typical analysis of a gas stream to be processed in accordance with this invention would be, in approximate mole percent, 79.1% methane, 10.0% ethane and other $C_2$ components, 5.4% propane and other $C_3$ components, 0.7% iso-butane, 1.6% normal butane, and 1.1% pentanes plus, with the balance made up of nitrogen and carbon dioxide. Sulfur containing gases are also sometimes present.

The present invention is generally concerned with the recovery of ethylene, ethane, propylene, propane, and heavier hydrocarbons from such gas streams. The historically cyclic fluctuations in the prices of both natural gas and its natural gas liquid (NGL) constituents have at times reduced the incremental value of ethane, ethylene, propane, propylene, and heavier components as liquid products. This has resulted in a demand for processes that can provide more efficient recoveries of these products, for processes that can provide efficient recoveries with lower capital investment, and for processes that can be easily adapted or adjusted to vary the recovery of a specific component over a broad range. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; 8,590,340; 8,881,549; 8,919,148; 9,021,831; 9,021,832; 9,052,136; 9,052,137; 9,057,558; 9,068,774; 9,074,814; 9,080,810; 9,080,811; 9,476,639; 9,637,428; 9,783,470; 9,927,171; 9,933,207; 9,939,195; 10,227,273; 10,533,794; 10,551,118; and 10,551,119; reissue U.S. Pat. No. 33,408; and co-pending published application nos. US20080078205A1; US20110067441A1; US20110067443A1; US20150253074A1; US20160069610A1; US20160377341A1; US20180347898A1; US20180347899A1; and US20190170435A1 describe relevant processes (although the description of the present invention in some cases is based on different processing conditions than those described in the cited U.S. Patents and co-pending applications).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product, or to separate residual methane, $C_2$ components, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be split into two streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the flash expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The methane product of the process, therefore, typically comprises vapors leaving the top fractionation stage of the column, together with vapors not subjected to any rectification step. Considerable losses of $C_2$, $C_3$, and $C_4$+ components occur because the top liquid feed contains substantial quantities of these components and heavier hydrocarbon components, resulting in corresponding equilibrium quantities of $C_2$ components, $C_3$ components, $C_4$ components, and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_2$ components, $C_3$ components, $C_4$ components, and heavier hydrocarbon components from the vapors.

In recent years, the preferred processes for hydrocarbon separation use an upper absorber section to provide additional rectification of the rising vapors. For many of these processes, the source of the reflux stream for the upper rectification section is a recycled stream of residue gas supplied under pressure. The recycled residue gas stream is usually cooled to substantial condensation by heat exchange with other process streams, e.g., the cold fractionation tower overhead. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typical process schemes of this type are disclosed in U.S. Pat. Nos. 4,889,545; 5,568,737; 5,881,569; 9,052,137; and 9,080,811 and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11-13, 2002. Unfortunately, in addition to the additional rectification section in the demethanizer, these processes also require the use of a compressor to provide the motive force for recycling the reflux stream to the demethanizer, adding to both the capital cost and the operating cost of facilities using these processes.

However, there are many gas processing plants that have been built in the U.S. and other countries according to U.S. Pat. Nos. 4,157,904 and 4,278,457 (as well as other processes) that have no upper absorber section to provide additional rectification of the rising vapors and cannot be easily modified to add this feature. Also, these plants do not usually have surplus compression capacity to allow recycling a reflux stream, nor do their demethanizer or deethanizer columns have surplus fractionation capacity to accommodate the increase in feed rate that results when a new reflux stream is added. As a result, these plants are not as efficient when operated to recover $C_2$ components and heavier components from the gas (commonly referred to as "ethane recovery"), and are particularly inefficient when operated to recover only the $C_3$ components and heavier components from the gas (commonly referred to as "ethane rejection").

The present invention also employs an upper rectification section (or a separate rectification column in some embodiments) and a recycled stream of residue gas supplied under pressure. However, the bulk of the reflux for this upper rectification section is provided by cooling a stream derived from the feed gas to substantial condensation and then expanding the stream to the operating pressure of the fractionation tower. During expansion, a portion of the stream is vaporized, resulting in cooling of the total stream. The cooled, expanded stream is supplied to the tower at an upper mid-column feed point where, along with the condensed liquid in the recycle stream in the top column feed (which is predominantly liquid methane), it can then be used to absorb $C_2$ components, $C_3$ components, $C_4$ components, and heavier hydrocarbon components from the vapors rising through the upper rectification section and thereby capture these valuable components in the bottom liquid product from the demethanizer.

The present invention is also a novel means of providing additional rectification that can be added easily to existing gas processing plants to increase the recovery of the desired $C_2$ components and $C_3$ components without requiring additional compression or fractionation capacity. The incremental value of this increased recovery is often substantial.

In accordance with the present invention, it has been found that $C_2$ recovery in excess of 92% and $C_3$ and $C_4$+ recoveries in excess of 99% can be obtained. In addition, the present invention makes possible essentially 100% separation of methane (or $C_2$ components) and lighter components from the $C_2$ components (or $C_3$ components) and heavier components at the same energy requirements compared to the prior art while increasing the recovery level. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

Figure 2:
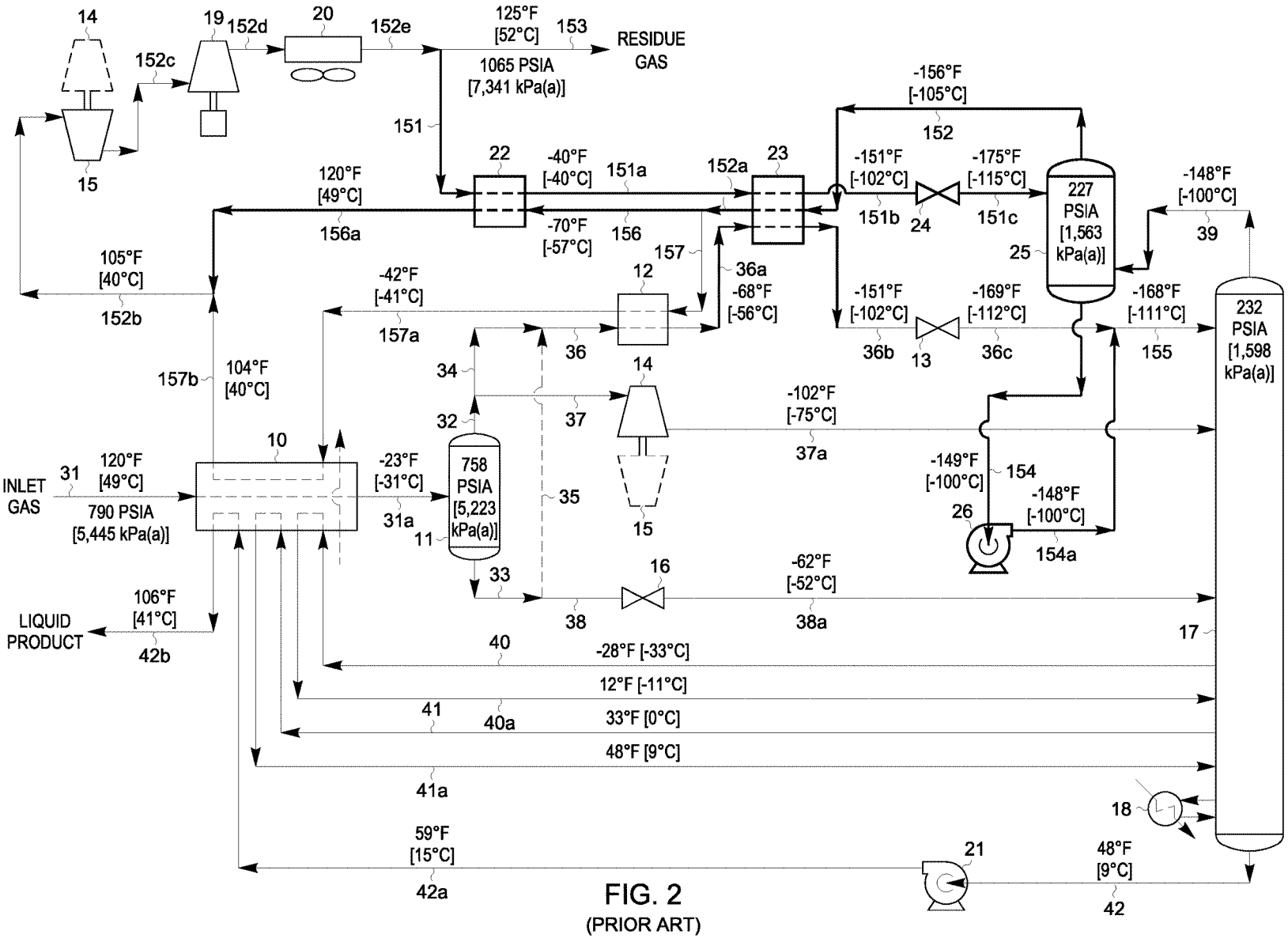
FIG. 2 (PRIOR ART)
Figure 3:
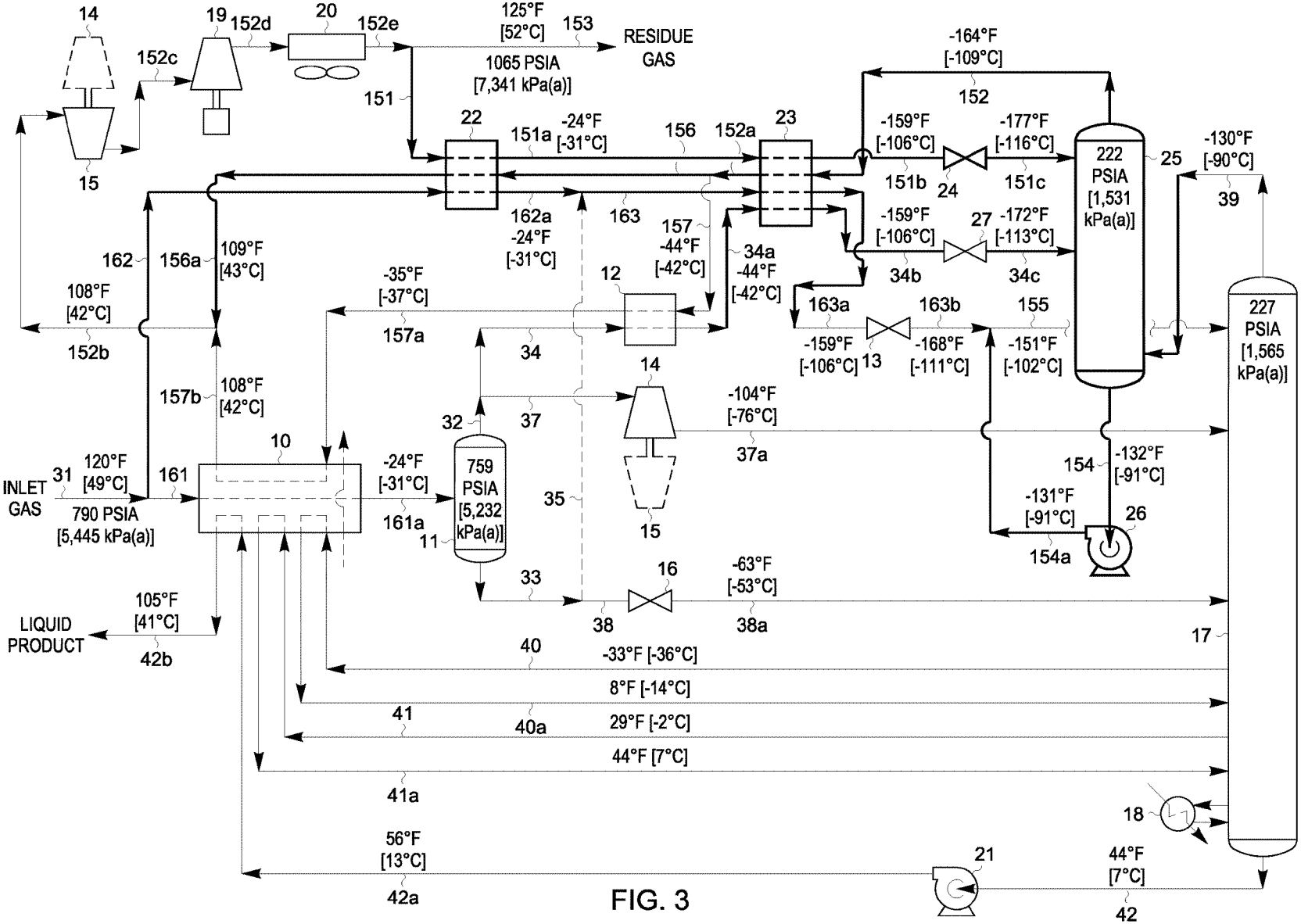
Figure 4:
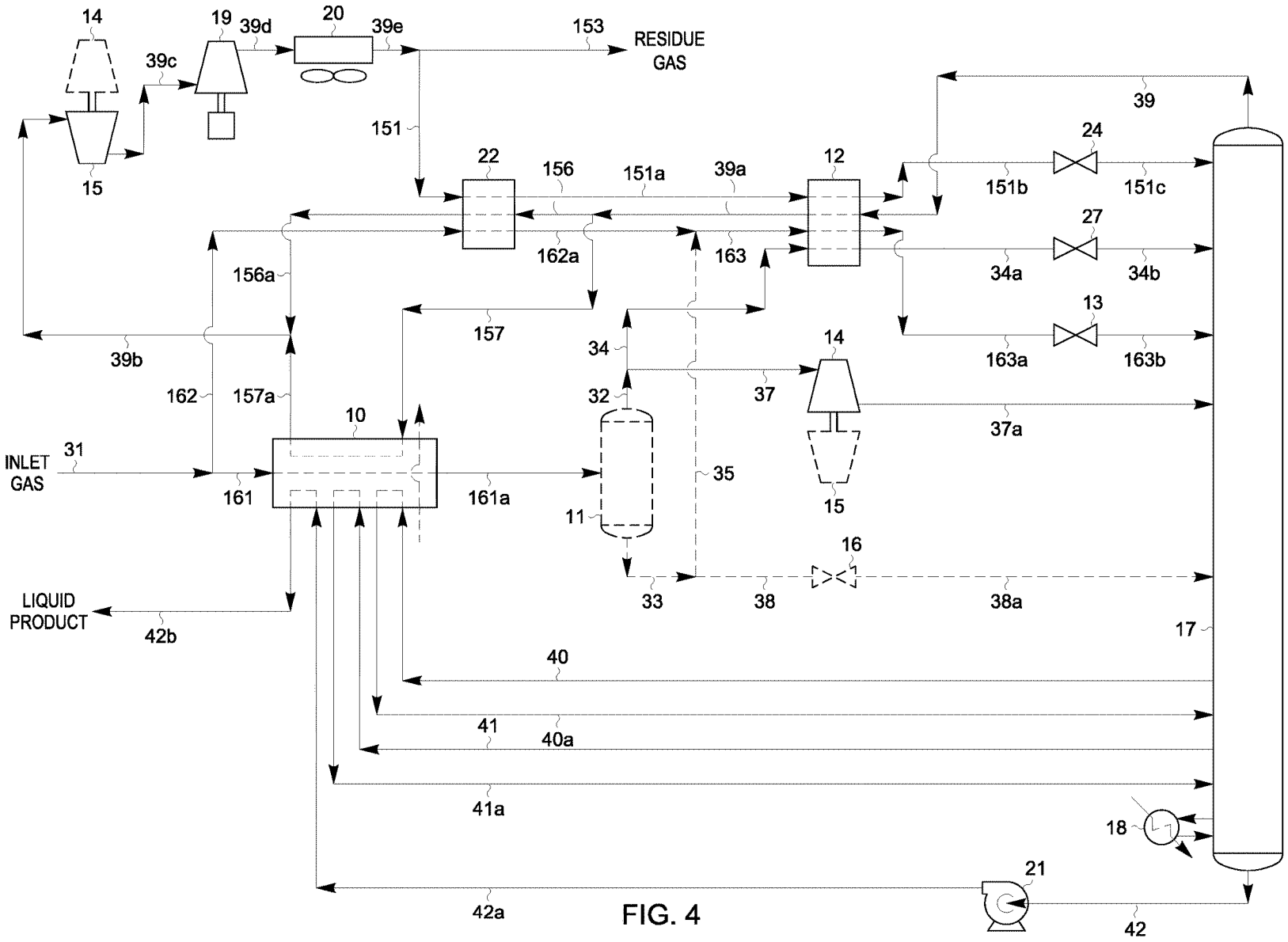
Figure 5:
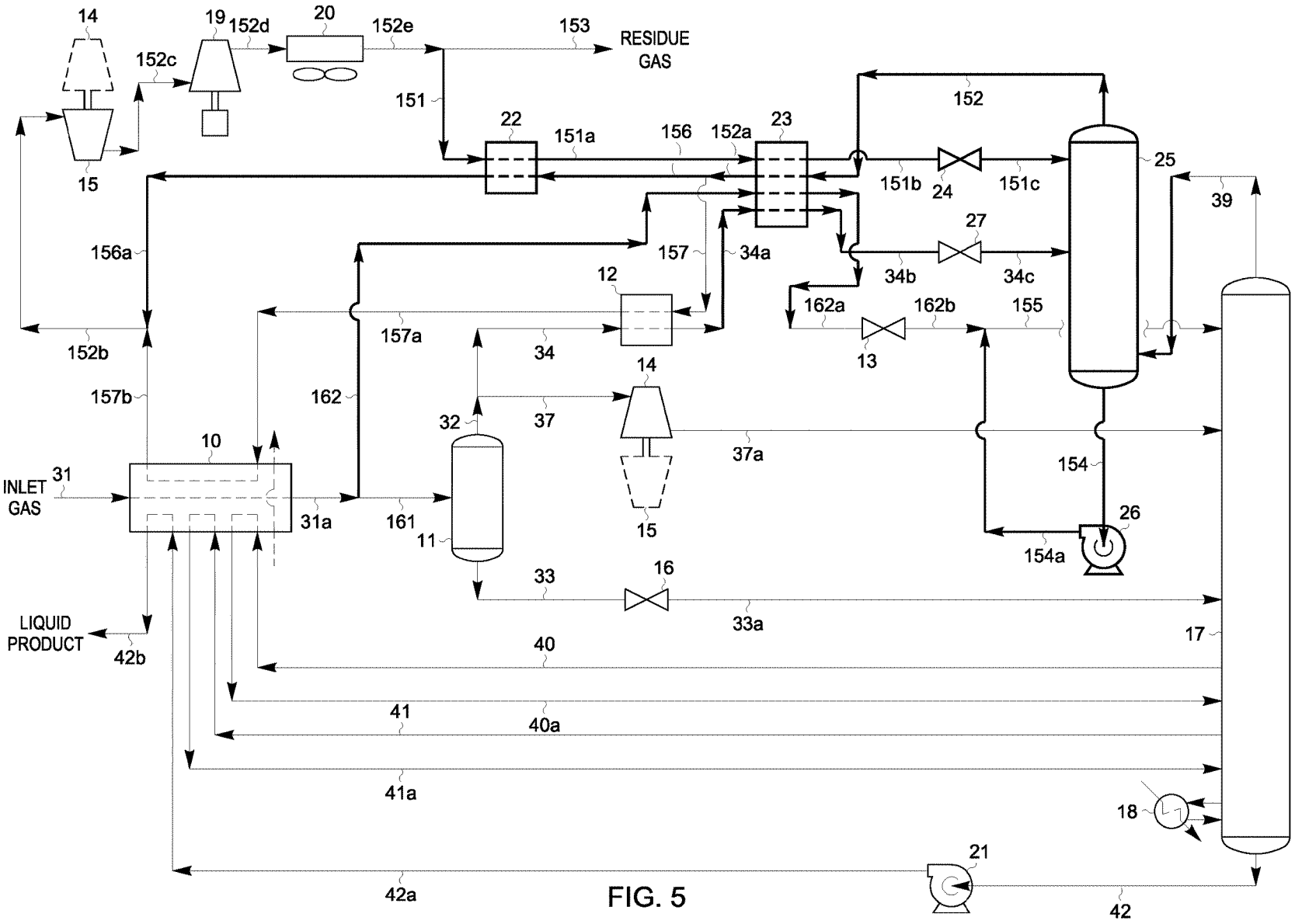
Figure 6:
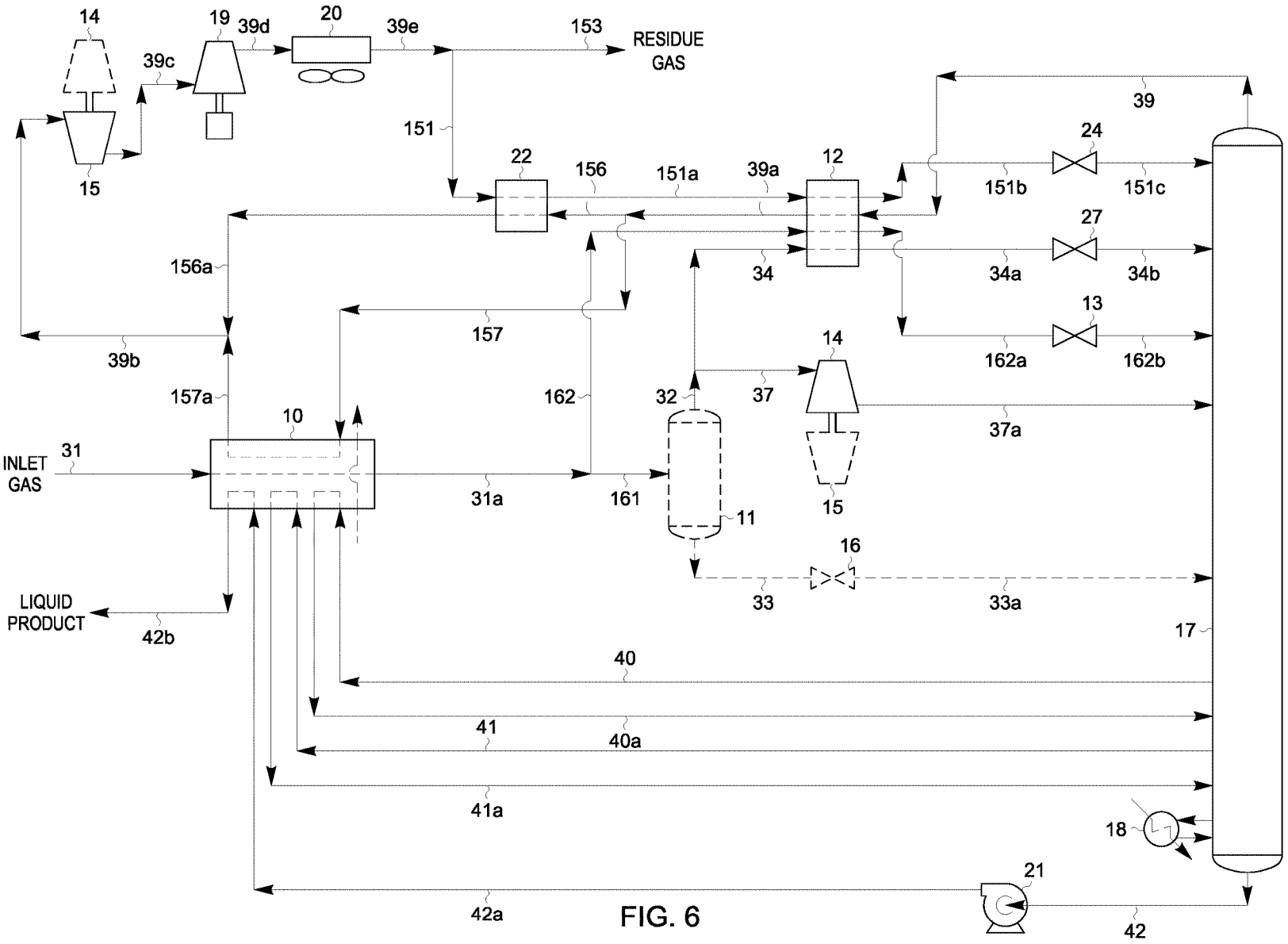

For a better understanding of the present invention, reference is made to the following examples and drawings. Referring to the drawings:

FIG. 1 is a flow diagram of a prior art natural gas processing plant in accordance with U.S. Pat. No. 4,157,904 or 4,278,457;

FIG. 2 is a flow diagram of a prior art natural gas processing plant adapted to operate in accordance with U.S. Pat. No. 5,568,737;

FIG. 3 is a flow diagram of a natural gas processing plant in accordance with the present invention; and FIGS. 4 through 6 are flow diagrams illustrating alternative means of application of the present invention to a natural gas stream.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

FIG. 1 is a process flow diagram showing the design of a processing plant to recover $C_2$+ components from natural gas using prior art according to U.S. Pat. No. 4,157,904 or 4,278,457. In this simulation of the process, inlet gas enters the plant at 120° F. [49° C.] and 790 psia [5,445 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with cool residue gas (stream 39*a*), pumped liquid product at 48° F. [9° C.] (stream 42*a*), demethanizer reboiler liquids at 21° F. [−6° C.] (stream 41), demethanizer side reboiler liquids at −42° F. [−41° C.] (stream 40), and propane refrigerant. Note that in all cases exchangers 10 and 12 are representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) Stream 31*a* then enters separator 11 at −28° F. [−33° C.] and 765 psia [5,275 kPa(a)] where the vapor (stream 32) is separated from the condensed liquid (stream 33).

The vapor (stream 32) from separator 11 is divided into two streams, 34 and 37. The liquid (stream 33) from separator 11 is optionally divided into two streams, 35 and 38. (If stream 35 contains any portion of the separator liquid, then the process of FIG. 1 is according to U.S. Pat. No. 4,157,904. Otherwise, the process of FIG. 1 is according to U.S. Pat. No. 4,278,457.) For the process illustrated in FIG. 1, stream 35 contains none of the total separator liquid. Stream 34, containing about 28% of the total separator vapor, passes through heat exchanger 12 in heat exchange relation with the cold residue gas (stream 39) where it is cooled to substantial condensation. The resulting substantially condensed stream 36*a* at −141° F. [−96° C.] is then flash expanded through expansion valve 13 to the operating pressure (approximately 203 psia [1,398 kPa(a)]) of fractionation tower 17. During expansion a portion of the stream is vaporized, resulting in cooling of the total stream. In the process illustrated in FIG. 1, the expanded stream 36*b* leaving expansion valve 13 reaches a temperature of −174° F. [−114° C.] and is supplied to separator section 17*a* in the upper region of fractionation tower 17. The liquids separated therein become the top feed to rectifying section 17*b*.

The remaining 72% of the vapor from separator 11 (stream 37) enters a work expansion machine 14 in which mechanical energy is extracted from this portion of the high pressure feed. The machine 14 expands the vapor substantially isentropically to the tower operating pressure, with the work expansion cooling the expanded stream 37*a* to −115° F. [−82° C.]. The typical commercially available expanders are capable of recovering on the order of 80-85% of the work theoretically available in an ideal isentropic expansion. The work recovered is often used to drive a centrifugal compressor (such as item 15) that can be used to re-compress the residue gas (stream 39*b*), for example. The partially condensed expanded stream 37*a* is thereafter supplied as feed to fractionation tower 17 at an upper mid-column feed point. The remaining separator liquid in stream 38 (if any) is expanded to the operating pressure of fractionation tower 17 by expansion valve 16, cooling stream 38*a* to −72° F. [−58° C.] before it is supplied to fractionation tower 17 at a lower mid-column feed point.

The demethanizer in tower 17 is a conventional distillation column containing a plurality of vertically spaced trays, one or more packed beds, or some combination of trays and packing. As is often the case in natural gas processing plants, the fractionation tower may consist of three sections. The upper section 17*a* is a separator wherein the partially vaporized top feed is divided into its respective vapor and liquid portions, and wherein the vapor rising from the intermediate rectifying or absorbing section 17*b* is combined with the vapor portion of the top feed to form the cold demethanizer overhead vapor (stream 39) which exits the top of the tower. The intermediate rectifying (absorbing) section 17*b* contains the trays and/or packing to provide the necessary contact between the vapor portions of the expanded streams 37*a* and 38*a* rising upward and cold liquid falling downward to condense and absorb the $C_2$ components, $C_3$ components, and heavier components. The lower demethanizing or stripping section 17*c* contains the trays and/or packing and provides the necessary contact between the liquids falling downward and the vapors rising upward. The demethanizing section 17*c* also includes reboilers (such as the reboiler and the side reboiler described previously and optional supplemental reboiler 18) which heat and vaporize a portion of the liquids flowing down the column to provide the stripping vapors which flow up the column to strip the liquid product, stream 42, of methane and lighter components.

The liquid product stream 42 exits the bottom of the tower at 37° F. [3° C.], based on a typical specification of a methane concentration of 0.5% on a volume basis in the bottom product. The residue gas (demethanizer overhead vapor stream 39) passes countercurrently to the incoming feed gas in heat exchanger 12 where it is heated from −156° F. [−104° C.] to −57° F. [−49° C.] (stream 39*a*) and in heat exchanger 10 where it is heated to 110° F. [43° C.] (stream 39*b*). The residue gas is then re-compressed in two stages. The first stage is compressor 15 driven by expansion machine 14. The second stage is compressor 19 driven by a supplemental power source which compresses the residue gas (stream 39*d*) to sales line pressure. After cooling to 125° F. [52° C.] in discharge cooler 20, the residue gas product (stream 39*e*) flows to the sales gas pipeline at 1065 psia [7,341 kPa(a)], sufficient to meet line requirements (usually on the order of the inlet pressure).

A summary of stream flow rates and energy consumption for the process illustrated in FIG. 1 is set forth in the following table:

TABLE I (FIG. 1)

| Stream Flow Summary - Lb. Moles/Hr [kg moles/Hr] | | | | | |
|---|---|---|---|---|---|
| Stream | Methane | Ethane | Propane | Butanes+ | Total |
| 31 | 19,089 | 2,416 | 1,292 | 826 | 24,147 |
| 32 | 17,283 | 1,558 | 455 | 99 | 19,901 |
| 33/38 | 1,806 | 858 | 837 | 727 | 4,246 |
| 34/36 | 4,825 | 435 | 127 | 28 | 5,556 |
| 37 | 12,458 | 1,123 | 328 | 71 | 14,345 |
| 39 | 19,054 | 347 | 4 | 0 | 19,928 |
| 42 | 35 | 2,069 | 1,288 | 826 | 4,219 |

| Recoveries* | |
|---|---|
| Ethane | 85.65% |
| Propane | 99.68% |
| Butanes+ | 99.99% |

| Power | | |
|---|---|---|
| Residue Gas Compression | 18,225 HP | [29,962 kW] |
| Refrigerant Compression | 4,072 HP | [6,694 kW] |
| Total Compression | 22,297 HP | [36,656 kW] |

*(Based on un-rounded flow rates)

FIG. 2 is a process flow diagram showing one means of improving the performance of the FIG. 1 process to recover more of the $C_2$ components in the bottom liquid product. FIG. 1 can be adapted to use the process of U.S. Pat. No. 5,568,737 as shown in FIG. 2. The feed gas composition and conditions considered in the process presented in FIG. 2 are the same as those in FIG. 1. Accordingly, the FIG. 2 process can be compared with that of the FIG. 1 process. In the simulation of this process, as in the simulation for the process of FIG. 1, operating conditions were selected to maximize the recovery level for a given energy consumption.

Most of the process conditions shown for the FIG. 2 process are much the same as the corresponding process conditions for the FIG. 1 process. The main difference is the addition of a rectification column 25 that uses a recycle stream from the residue gas as its top feed to recover additional $C_2$ components and heavier components from fractionation tower 17 overhead vapor stream 39 supplied to rectification column 25 as its bottom feed.

Rectified overhead vapor stream 152 leaves the upper region of rectification tower 25 at −156° F. [−105° C.] and is directed into heat exchanger 23 where it provides cooling to partially cooled recycle stream 151*a* and partially cooled stream 36*a* before the heated stream 152*a* at −70° F. [−57° C.] is divided into streams 156 and 157. Stream 156 flows to heat exchanger 22 where it is heated to 120° F. [49° C.] as it provides cooling to recycle stream 151, while stream 157 flows to heat exchanger 12 and heat exchanger 10 as described previously. The resulting warm streams 156*a* and 157*b* recombine to form stream 152*b* at 105° F. [40° C.], which is compressed and cooled as described previously to form stream 152*e*. Stream 152*e* is then divided to form recycle stream 151 and the residue gas product (stream 153).

Recycle stream 151 is cooled to −151° F. [−102° C.] and substantially condensed in heat exchanger 22 and heat exchanger 23, then flash expanded through expansion valve 24 to the operating pressure (approximately 227 psia [1,563 kPa(a)]) of rectification column 25 (slightly lower than the operating pressure of fractionation tower 17). During expansion a portion of the stream is vaporized, resulting in cooling of the total stream. In the process illustrated in FIG. 2, the expanded stream 151*c* leaving expansion valve 24 is cooled to −175° F. [−115° C.] and supplied as the top feed to rectification column 25.

Rectification column 25 is a conventional absorption column containing a plurality of vertically spaced trays, one or more packed beds, or some combination of trays and packing. As is often the case in natural gas processing plants, the rectification column may consist of two sections. The upper section is a separator wherein the partially vaporized top feed is divided into its respective vapor and liquid portions, and wherein the vapor rising from the lower rectification section is combined with the vapor portion of the top feed to form the rectified overhead vapor (stream 152) which exits the top of the column. The lower, rectifying section contains the trays and/or packing and provides the necessary contact between the liquids falling downward and the vapors rising upward so that the cold liquid reflux from stream 151*c* absorbs and condenses the $C_2$ components, $C_3$ components, and heavier components rising in the rectifying section of rectification column 25. The liquid (stream 154) leaving the bottom of rectification column 25 at −149° F. [−100° C.] is pumped to higher pressure by pump 26 and combined with flash expanded stream 36*c*, with the resulting stream 155 at −168° F. [−111° C.] supplied to fractionation tower 17 at its top feed point.

A summary of stream flow rates and energy consumption for the process illustrated in FIG. 2 is set forth in the following table:

TABLE II (FIG. 2)

| Stream Flow Summary - Lb. Moles/Hr [kg moles/Hr] | | | | | |
|---|---|---|---|---|---|
| Stream | Methane | Ethane | Propane | Butanes+ | Total |
| 31 | 19,089 | 2,416 | 1,292 | 826 | 24,147 |
| 32 | 17,516 | 1,642 | 503 | 113 | 20,282 |
| 33/38 | 1,573 | 774 | 789 | 713 | 3,865 |
| 34/36 | 4,611 | 432 | 132 | 30 | 5,339 |
| 37 | 12,905 | 1,210 | 371 | 83 | 14,943 |
| 39 | 19,273 | 453 | 5 | 0 | 20,256 |
| 151 | 1,157 | 19 | 0 | 0 | 1,208 |
| 152 | 20,210 | 339 | 0 | 0 | 21,105 |
| 156 | 1,314 | 22 | 0 | 0 | 1,372 |
| 157 | 18,896 | 317 | 0 | 0 | 19,733 |
| 154 | 220 | 133 | 5 | 0 | 359 |
| 155 | 4,831 | 565 | 137 | 30 | 5,698 |
| 153 | 19,053 | 320 | 0 | 0 | 19,897 |
| 42 | 36 | 2,096 | 1,292 | 826 | 4,250 |

| Recoveries* | |
|---|---|
| Ethane | 86.77% |
| Propane | 100.00% |
| Butanes+ | 100.00% |

| Power | | |
|---|---|---|
| Residue Gas Compression | 18,198 HP | [29,917 kW] |
| Refrigerant Compression | 4,028 HP | [6,622 kW] |
| Total Compression | 22,226 HP | [36,539 kW] |

*(Based on un-rounded flow rates)

A comparison of Tables I and II shows that, compared to the FIG. 1 process, the FIG. 2 process improves ethane recovery from 85.65% to 86.77%, propane recovery from 99.68% to 100.00%, and butane+ recovery from 99.99% to 100.00%. Comparison of Tables I and II further shows that these increased product yields were achieved without using additional power.

DESCRIPTION OF THE INVENTION

FIG. 3 illustrates a flow diagram of a process in accordance with the present invention. The feed gas composition and conditions considered in the process presented in FIG. 3 are the same as those in FIGS. 1 and 2. Accordingly, the FIG. 3 process can be compared with that of the FIGS. 1 and 2 processes to illustrate the advantages of the present invention.

Most of the process conditions shown for the FIG. 3 process are much the same as the corresponding process conditions for the FIG. 2 process. The main differences are the disposition of flash expanded substantially condensed stream 34*c*, and the new top feed for fractionation column 17 formed from a portion of the feed gas (stream 162) and the pumped liquid (stream 154*a*) from rectification column 25. In the FIG. 3 process, feed gas stream 31 is divided into two streams, stream 161 and stream 162. Stream 161 is directed to heat exchanger 10 to be cooled as described previously, and enters separator 11 at −24° F. [−31° C.] and 759 psia [5,232 kPa(a)] to be separated into vapor stream 32 and liquid stream 33. Streams 32 and 33 are then processed much as before.

However, partially cooled stream 34*a* at −44° F. [−42° C.] is further cooled to −159° F. [−106° C.] and substantially condensed in heat exchanger 23 before it is flash expanded through expansion valve 27 to the operating pressure (approximately 222 psia [1,531 kPa(a)]) of rectification column 25 (slightly below the operating pressure of fractionation tower 17). During expansion a portion of the stream may be vaporized, resulting in cooling of the total stream. In the process illustrated in FIG. 3, the expanded stream 34*c* leaving expansion valve 27 is cooled to −172° F. [−113° C.] and directed to a mid-column feed point on rectification column 25.

The other portion of the feed gas (stream 162) is directed to heat exchanger 22 and heat exchanger 23 and is cooled to −159° F. [−106° C.] and substantially condensed (stream 163*a*). Stream 163*a* is then flash expanded through expansion valve 13 to slightly above the operating pressure (approximately 227 psia [1,565 kPa(a)]) of fractionation tower 17. During expansion a portion of stream 163*b* may be vaporized, resulting in cooling of the total stream to −168° F. [−111° C.]. Recycle stream 151 is likewise cooled to −159° F. [−106° C.] and substantially condensed in heat exchanger 22 and heat exchanger 23 and then flash expanded through expansion valve 24 to the operating pressure of rectification column 25. During expansion a portion of the stream may be vaporized, resulting in cooling of the total stream. In the process illustrated in FIG. 3, the expanded stream 151*c* leaving expansion valve 24 at −177° F. [−116° C.] is directed to a top column feed point on rectification column 25.

Overhead vapor stream 39 at −130° F. [−90° C.] is withdrawn from an upper region of fractionation tower 17 and directed to the bottom column feed point of rectification column 25. Rectification column 25 is a conventional absorption column containing a plurality of vertically spaced trays, one or more packed beds, or some combination of trays and packing. As is often the case in natural gas processing plants, the rectification column may consist of two sections. The upper section is a separator wherein the partially vaporized top feed is divided into its respective vapor and liquid portions, and wherein the vapor rising from the lower rectification section is combined with the vapor portion of the top feed to form the rectified overhead vapor (stream 152) which exits the top of the column. The lower, rectifying section contains the trays and/or packing and provides the necessary contact between the liquids falling downward and the vapors rising upward so that the cold liquid reflux from streams 151*c* and 34*c* absorbs and condenses the $C_2$ components, $C_3$ components, and heavier components rising in the rectifying section of rectification column 25. The liquid (stream 154) leaving the bottom of rectification column 25 at −132° F. [−91° C.] is pumped to higher pressure by pump 26 and combined with flash expanded stream 163*b*, with the resulting stream 155 at −151° F. [−102° C.] supplied to fractionation tower 17 at its top feed point.

Rectified overhead vapor stream 152 leaves the upper region of rectification tower 25 at −164° F. [−109° C.] and is directed into heat exchanger 23 where it provides cooling to partially cooled recycle stream 151*a*, the partially cooled portion of the feed gas (stream 163), and partially cooled stream 34*a* before the heated stream 152*a* at −44° F. [−42° C.] is divided into streams 156 and 157. Stream 156 flows to heat exchanger 22 where it is heated to 109° F. [43° C.] as it provides cooling to recycle stream 151 and the portion of the feed gas (stream 162), while stream 157 flows to heat exchanger 12 and heat exchanger 10 as described previously. The resulting warm streams 156*a* and 157*b* recombine to form stream 152*b* at 108° F. [42° C.], which is compressed and cooled as described previously to form stream 152*e* at 125° F. [52° C.] and 1065 psia [7,341 kPa(a)]. Stream 152*e* is then divided to form recycle stream 151 and the residue gas product (stream 153).

A summary of stream flow rates and energy consumption for the process illustrated in FIG. 3 is set forth in the following table:

TABLE III (FIG. 3)

Stream Flow Summary - Lb. Moles/Hr [kg moles/Hr]

| Stream | Methane | Ethane | Propane | Butanes+ | Total |
|---|---|---|---|---|---|
| 31 | 19,089 | 2,416 | 1,292 | 826 | 24,147 |
| 161 | 17,333 | 2,194 | 1,173 | 750 | 21,925 |
| 162/163 | 1,756 | 222 | 119 | 76 | 2,222 |
| 32 | 15,882 | 1,482 | 451 | 101 | 18,378 |
| 33/38 | 1,451 | 712 | 722 | 649 | 3,547 |
| 34 | 3,131 | 292 | 89 | 20 | 3,624 |
| 37 | 12,751 | 1,190 | 362 | 81 | 14,754 |
| 39 | 16,743 | 832 | 13 | 1 | 18,024 |
| 151 | 1,164 | 11 | 0 | 0 | 1,208 |
| 152 | 20,216 | 195 | 0 | 0 | 20,968 |
| 156 | 14,920 | 144 | 0 | 0 | 15,474 |
| 157 | 5,296 | 51 | 0 | 0 | 5,494 |
| 154 | 822 | 940 | 102 | 21 | 1,888 |
| 155 | 2,578 | 1,162 | 221 | 97 | 4,110 |
| 153 | 19,052 | 184 | 0 | 0 | 19,760 |
| 42 | 37 | 2,232 | 1,292 | 826 | 4,387 |

Recoveries*

| | |
|---|---|
| Ethane | 92.40% |
| Propane | 100.00% |
| Butanes+ | 100.00% |

Power

| | | |
|---|---|---|
| Residue Gas Compression | 18,190 HP | [29,904 kW] |
| Refrigerant Compression | 4,049 HP | [6,656 kW] |
| Total Compression | 22,239 HP | [36,560 kW] |

*(Based on un-rounded flow rates)

The magnitude of the performance increase of the present invention over that of the prior art is unexpectedly large. A comparison of Tables I and III shows that, compared to the FIG. 1 process, the FIG. 3 process improves ethane recovery from 85.65% to 92.40% (an increase of nearly 7 percentage points), propane recovery from 99.68% to 100.00%, and butane+ recovery from 99.99% to 100.00%. Comparison of Tables I and III further shows that these increased product yields were achieved without using additional power. In terms of the recovery efficiency (defined by the quantity of ethane recovered per unit of power), the present invention represents a very significant 8% improvement over the prior art of the FIG. 1 process.

A comparison of Tables II and III shows that, compared to the FIG. 2 process, the FIG. 3 process improves ethane recovery from 86.77% to 92.40% (an increase of over 5 percentage points) and the propane and butane+ recoveries are the same (100.00%). Comparison of Tables II and III further shows that these increased product yields were achieved without using additional power. In terms of the recovery efficiency (defined by the quantity of ethane recovered per unit of power), the present invention represents a very significant 6% improvement over the prior art of the FIG. 2 process.

The improvement in the recovery efficiency of the present invention over that of the prior art processes can be understood by examining the improvement in the rectification that the present invention provides compared to that provided for rectifying section 17*b* of the FIGS. 1 and 2 processes and rectification column 25 of the FIG. 2 process. Whereas the FIG. 1 process has a single reflux stream (stream 36*b*) for its rectifying section 17*b* in column 17, the present invention has three reflux streams (streams 151*c* and 34*c* for rectification column 25 and stream 155 for the rectifying section 17*b* in column 17). Not only is the total quantity of reflux greater for the present invention (by about 61%), its top reflux stream (stream 151*c*) is of much better quality since it is nearly pure methane, whereas the top reflux stream 36*b* for the FIG. 1 process contains more than 10% $C_2$ components and heavier components.

While the FIG. 2 process improves over the FIG. 1 process with its dual reflux streams (stream 151*c* for rectification column 25 and stream 155 for the rectifying section 17*b* in column 17), the total amount of reflux is 23% less than the triple reflux streams in the present invention. Further, the single reflux stream supplied to rectification column 25 for the FIG. 2 process is only 25% of the total reflux supplied to rectification column 25 for the present invention, making it less capable of rectifying overhead vapor stream 39 from column 17. Rectification column 25 of the present invention also has less of stream 39 to rectify in the first place, since it uses a portion of the feed gas (substantially condensed expanded stream 163*b*) to provide partial rectification of the tower vapors in rectifying section 17*b* of column 17 so that less rectification is needed in column 25. The combination of these factors results in an increase in the $C_2$ component recovery for the present invention of nearly 7 percentage points over that of the FIG. 1 process and over 5 percentages points over that of the FIG. 2 process.

One important advantage of the present invention is how easily it can be incorporated into an existing gas processing plant to achieve the superior performance described above. As shown in FIG. 3, only six connections (commonly referred to as "tie-ins") to the existing plant are needed: for the feed gas split (stream 162), for the partially condensed stream (stream 34*a*), for the pumped liquids from rectification column 25 (stream 154*a*), for the fractionation column 17 overhead vapor (stream 39), for the heated residue gas (stream 156*a*), and for the compressed recycle gas (stream 151). The existing plant can continue to operate while the new heat exchangers 22 and 23, column 25, and pump 26 are installed near fractionation tower 17, with just a short plant shutdown when installation is complete to make the new tie-ins to these six existing lines. The plant can then be restarted, with all of the existing equipment remaining in service and operating exactly as before, except that the product recovery is now higher with no increase in compression power.

Another advantage of the present invention is that there is less flow through the existing plant because part of the feed gas (stream 162) is split around the existing heat exchangers and separator, which results in less vapor/liquid traffic inside fractionation tower 17. This means there is a potential to process more feed gas and increase the plant revenue without debottlenecking the existing equipment if there is spare compression power available for the higher feed gas throughput.

OTHER EMBODIMENTS

The present invention can also be applied in a new plant as shown in FIGS. 4 and 6. Depending on the quantity of heavier hydrocarbons in the feed gas and the feed gas pressure, the cooled feed stream 161*a* (FIG. 4) or 31*a* (FIG. 6) leaving heat exchanger 10 may not contain any liquid (because it is above its dewpoint, or because it is above its cricondenbar). In such cases, separator 11 shown in FIGS. 4 and 6 is not required.

In accordance with the present invention, the splitting of the feed gas may be accomplished in several ways. In the processes of FIGS. 3 and 4, the splitting of the feed gas occurs before any cooling of the feed gas. In such cases, cooling and substantial condensation of one portion of the feed gas in multiple heat exchangers may be favored in some circumstances, such as heat exchangers 22 and 23 shown in FIG. 3 or heat exchangers 22 and 12 shown in FIG. 4. The feed gas may also be split, however, following cooling (but prior to separation of any liquids which may have been formed) as shown in FIGS. 5 and 6.

The high pressure liquid (stream 33 in FIGS. 3 and 4) need not be expanded and fed to a mid-column feed point on the distillation column. Instead, all or a portion of it may be combined with the portion of the cooled feed gas (stream 162*a*) leaving heat exchanger 22 in FIGS. 3 and 4. (This is shown by the dashed stream 35 in FIGS. 3 and 4.) Any remaining portion of the liquid (stream 38 in FIGS. 3 and 4) may be expanded through an appropriate expansion device, such as expansion valve 16 or an expansion machine, and fed to a mid-column feed point on the distillation column (stream 38*a*). Stream 38 may also be used for inlet gas cooling or other heat exchange service before or after the expansion step prior to flowing to the demethanizer.

As described earlier, a portion of the feed gas (stream 162) and a portion of the separator vapor (stream 34) are substantially condensed and the resulting condensate used to absorb valuable $C_2$ components, $C_3$ components, and heavier components from the vapors rising through rectifying section 17*b* of demethanizer 17 (FIGS. 4 and 6), or through rectification column 25 and rectifying section 17*b* of column 17 (FIGS. 3 and 5). However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass rectifying section 17*b* of demethanizer 17 (FIGS. 4 and 6), or rectification column 25 and/or rectifying section 17*b* of column 17 (FIGS. 3 and 5).

Feed gas conditions, plant size, available equipment, or other factors may indicate that elimination of work expansion machine 14, or replacement with an alternate expansion device (such as an expansion valve), is feasible. Although individual stream expansion is depicted in particular expansion devices, alternative expansion means may be employed where appropriate. For example, conditions may warrant work expansion of the substantially condensed portion of the separator vapor (stream 34*b* in FIGS. 3 and 5 and stream 34*a* in FIGS. 4 and 6) or the substantially condensed portion of the feed stream (stream 163*a* in FIGS. 3 and 4 and stream 162*a* in FIGS. 5 and 6).

In accordance with the present invention, the use of external refrigeration to supplement the cooling available to the inlet gas, separator vapor, and/or recycle stream from other process streams may be employed, particularly in the case of a rich inlet gas. The use and distribution of separator liquids and demethanizer side draw liquids for process heat exchange, and the particular arrangement of heat exchangers for inlet gas and separator vapor cooling must be evaluated for each particular application, as well as the choice of process streams for specific heat exchange services.

It will also be recognized that the relative amount of feed found in each branch of the split vapor feeds will depend on several factors, including gas pressure, feed gas composition, the amount of heat which can economically be extracted from the feed, and the quantity of horsepower available. More feed to the top of the column may increase recovery while decreasing power recovered from the expander thereby increasing the recompression horsepower requirements. Increasing feed lower in the column reduces the horsepower consumption but may also reduce product recovery. The relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position.

The present invention provides improved recovery of $C_2$ components, $C_3$ components, and heavier hydrocarbon components or of $C_3$ components and heavier hydrocarbon components per amount of utility consumption required to operate the process. An improvement in utility consumption required for operating the process may appear in the form of reduced power requirements for compression or re-compression, reduced power requirements for external refrigeration, reduced energy requirements for supplemental heating, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for the separation of a gas stream containing methane, C2 components, C3 components, and heavier hydrocarbon components into a volatile residue gas fraction and a less volatile fraction containing a portion of said C2 components, C3 components, and heavier hydrocarbon components or said C3 components and heavier hydrocarbon components, wherein (a) said gas stream is cooled under pressure to provide a cooled stream;

(b) said cooled stream is expanded to a lower pressure whereby said cooled stream is further cooled; and (c) said further cooled stream is directed into a distillation column and fractionated at said lower pressure whereby the components of said less volatile fraction are recovered;

wherein prior to cooling, said gas stream is divided into first and second streams;

(1) said first stream is cooled to form a condensed first stream;

(2) said condensed first stream is expanded to said lower pressure to form an expanded condensed first stream that is thereafter supplied to said distillation column at a mid-column feed position;

(3) said second stream is cooled under pressure to form a partially condensed second stream;

(4) said partially condensed second stream is separated thereby to provide a vapor stream and at least one liquid stream;

(5) said vapor stream is divided into first and second portions;

(6) said first portion is cooled to form a condensed first portion;

(7) said condensed first portion is expanded to said lower pressure to form an expanded condensed first portion that is thereafter supplied to said distillation column at an upper mid-column feed position above said mid-column feed position;

(8) said second portion is expanded to said lower pressure to form an expanded second portion that is supplied to said distillation column at a lower mid-column feed position below said mid-column feed position;

(9) at least a portion of said at least one liquid stream is expanded to said lower pressure to form an expanded liquid stream that is supplied to said distillation column at another lower mid-column feed position below said mid-column feed position;

(10) a distillation vapor stream is collected from an upper region of said distillation column and heated to form a heated distillation vapor stream, said heating thereby to supply at least a portion of said cooling of steps (1), (3), and (6);

(11) said heated distillation vapor stream is compressed to higher pressure, cooled, and thereafter divided into said volatile residue gas fraction and a compressed recycle stream;

(12) said compressed recycle stream is cooled to form a condensed compressed recycle stream, said cooling thereby to supply at least a portion of said heating of step (10);

(13) said condensed compressed recycle stream is expanded to said lower pressure to form an expanded condensed compressed recycle stream that is thereafter supplied to said distillation column at a top feed position; and

(14) portions of components in said less volatile fraction are recovered.

2. The process according to claim 1 wherein (1) said gas stream is cooled under pressure to form a partially condensed gas stream;

(2) said partially condensed gas stream divided into said first stream and said second stream; and (3) said second stream is separated thereby to provide said vapor stream and said at least one liquid stream.

3. The process according to claim 1 wherein (1) said first stream is combined with at least a portion of said at least one liquid stream to form a combined stream;

(2) said combined stream is cooled to form a condensed combined stream;

(3) said condensed combined stream is expanded to said lower pressure to form an expanded condensed combined stream that is thereafter supplied to said distillation column at said mid-column feed position; and (4) any remaining portion of said at least one liquid stream is expanded to said lower pressure to form said expanded liquid stream.

4. The process according to claim 1 wherein (1) said expanded condensed first portion is supplied at a mid-column feed position to a contacting and separating device that produces said distillation vapor stream and a bottom liquid stream, whereupon said bottom liquid stream is supplied to said distillation column at said top feed position and wherein said contacting and separating device comprises an absorption column containing a plurality of vertically spaced trays, one or more packed beds or a combination of trays and packing;

(2) an overhead vapor stream is withdrawn from said upper region of said distillation column and is supplied to said contacting and separating device at a lower column feed position below said mid-column feed position;

(3) said expanded condensed compressed recycle stream is supplied at a top feed position to said contacting and separating device; and (4) an overhead temperature of said contacting and separating device is at a temperature whereby portions of components in said less volatile fraction are recovered.

5. The process according to claim 4 wherein (1) said gas stream is cooled under pressure to form a partially condensed gas stream;

(2) said partially condensed gas stream divided into said first stream and said second stream; and (3) said second stream is separated thereby to provide said vapor stream and said at least one liquid stream.

6. The process according to claim 4 wherein (1) said first stream is combined with at least a portion of said at least one liquid stream to form a combined stream;

(2) said combined stream is cooled to form a condensed combined stream;

(3) said condensed combined stream is expanded to said lower pressure to form an expanded condensed combined stream that is thereafter supplied to said distillation column at said top feed position; and (4) any remaining portion of said at least one liquid stream is expanded to said lower pressure to form said expanded liquid stream.

7. An apparatus for the separation of a gas stream containing methane, C2 components, C3 components, and heavier hydrocarbon components into a volatile residue gas fraction and a less volatile fraction containing a portion of said C2 components, C3 components, and heavier hydrocarbon components or said C3 components and heavier hydrocarbon components, in said apparatus there being (a) a first cooling means comprising a heat exchanger to cool said gas stream under pressure connected to provide a cooled stream under pressure;

(b) a first expansion means comprising an expansion valve or a work expansion machine connected to receive at least a portion of said cooled stream under pressure and expand said at least a portion of said cooled stream to a lower pressure, whereby said stream is further cooled; and (c) a distillation column connected to receive said further cooled stream, said distillation column being adapted to separate said further cooled stream into said volatile residue gas fraction and said less volatile fraction;

wherein said apparatus includes (1) a first dividing means comprising a piping tee prior to said first cooling means to divide said gas stream into first and second streams;

(2) a heat exchange means comprising a heat exchanger connected to said first dividing means to receive said first stream and cool said first stream to form a condensed first stream;

(3) said first expansion means connected to said heat exchange means, said first expansion means being adapted to receive said condensed first stream and expand said condensed first stream to said lower pressure to form an expanded condensed first stream, said first expansion means being further connected to said distillation column to supply said expanded condensed first stream to said distillation column at a mid-column feed position;

(4) said first cooling means connected to said first dividing means to receive said second stream and cool said second stream under pressure to form a partially condensed second stream;

(5) a separating means comprising a vessel to separate a two-phase into vapor and liquid connected to said first cooling means to receive said partially condensed second stream and separate said partially condensed second stream into a vapor stream and at least one liquid stream;

(6) a second dividing means comprising a piping tee connected to said separating means to receive said vapor stream and divide said vapor stream into first and second portions;

(7) said heat exchange means further connected to said second dividing means to receive said first portion and cool first portion to form a condensed first portion;

(8) a second expansion means comprising an expansion valve connected to said heat exchange means to receive said condensed first portion and expand said condensed first portion to said lower pressure to form an expanded condensed first portion, said second expansion means being further connected to said distillation column to supply said expanded condensed first portion to said distillation column at an upper mid-column feed position above said mid-column feed position;

(9) a third expansion means comprising an expansion valve being connected to said second dividing means to receive said second portion and expand said second portion to said lower pressure to form an expanded second portion, said third expansion means being further connected to said distillation column to supply said expanded second portion to said distillation column at a lower mid-column feed position below said mid-column feed position;

(10) a fourth expansion means comprising an expansion valve connected to said separating means to receive at least a portion of said at least one liquid stream and expand said at least one liquid stream to said lower pressure to form an expanded liquid stream, said fourth expansion means being further connected to said distillation column to supply said expanded liquid stream to said distillation column at another lower mid-column feed position below said mid-column feed position;

(11) an overhead stream line from a top of said distillation column to receive a distillation vapor stream from an upper region of said distillation column;

(12) said heat exchange means further connected to said overhead stream line to receive said distillation vapor stream and heat said distillation vapor stream to form a heated distillation vapor stream, thereby to supply at least a portion of said cooling of elements (2) and (7);

(13) a compressing means comprising a compressor connected to said heat exchange means to receive said heated distillation vapor stream and compress said heated distillation vapor stream to higher pressure to form a compressed heated distillation vapor stream;

(14) a second cooling means comprising a heat exchanger connected to said compressing means to receive said compressed heated distillation vapor stream and cool aid compressed heated distillation vapor stream to form a cooled compressed heated distillation vapor stream;

(15) a third dividing means comprising a piping tee connected to said second cooling means to receive said cooled compressed heated distillation vapor stream and divide said cooled compressed heated distillation vapor stream into said volatile residue gas fraction and a compressed recycle stream;

(16) said heat exchange means further connected to said third dividing means to receive said compressed recycle stream and cool said compressed recycle stream to form a condensed compressed recycle stream, thereby to supply at least a portion of said heating of element (12); and

(17) a fifth expansion means comprising an expansion valve or a work expansion machine connected to said heat exchange means to receive said condensed compressed recycle stream and expand condensed compressed recycle stream to said lower pressure to form an expanded condensed compressed recycle stream, said fifth expansion means being further connected to said distillation column to supply said expanded condensed compressed recycle stream to said distillation column at a top feed position.

8. The apparatus according to claim 7 wherein (1) said first cooling means is connected to receive said gas stream and cool said gas stream under pressure to form a partially condensed gas stream;

(2) said first dividing means is connected to said first cooling means to receive said partially condensed gas stream and divide said partially condensed gas stream into said first stream and said second stream; and (3) said separating means is connected to said first dividing means to receive said second stream and separate said second stream into said vapor stream and said at least one liquid stream.

9. The apparatus according to claim 7 wherein (1) a combining means comprising a piping tee is connected to said first dividing means and said separating means to receive said first stream and at least a portion of said at least one liquid stream and form a combined stream;

(2) said heat exchange means is connected to said combining means to receive said combined stream and cool said second stream to form a condensed combined stream;

(3) said first expansion means is connected to said heat exchange means to receive said condensed combined stream and expand said condensed combined stream to said lower pressure to form an expanded condensed combined stream, said first expansion means being further connected to said distillation column to supply said expanded condensed combined stream to said distillation column at said mid-column feed position; and (4) said fourth expansion means is connected to said separating means to receive any remaining portion of said at least one liquid stream and expand said at least one liquid stream to said lower pressure to form said expanded liquid stream.

10. The apparatus according to claim 7 wherein (1) said second expansion means is connected to a contacting and separating means to supply said expanded condensed first portion to said contacting and separating means at a mid-column feed position, said contacting and separating means being adapted to produce said distillation vapor stream and a bottom liquid stream;

(2) said distillation column is connected to receive said bottom liquid stream at said top feed position, said distillation column being adapted to separate said bottom liquid stream into an overhead vapor stream and said less volatile fraction;

(3) said contacting and separating means is further connected to said distillation column to receive said overhead vapor stream at a lower column feed position below said mid-column feed position; and (4) said contacting and separating means is further connected to said fifth expansion means to receive said expanded condensed compressed recycle stream and supply said expanded condensed compressed recycle stream to said contacting and separating means at a top feed position.

11. The apparatus according to claim 10 wherein (1) said first cooling means is connected to receive said gas stream and cool said gas stream under pressure to form a partially condensed gas stream;

(2) said first dividing means is connected to said first cooling means to receive said partially condensed gas stream and divide said partially condensed gas stream into said first stream and said second stream; and (3) said separating means is connected to said first dividing means to receive said second stream and separate said second stream into said vapor stream and said at least one liquid stream.

12. The apparatus according to claim 10 wherein (1) a combining means comprising a piping tee is connected to said first dividing means and said separating means to receive said first stream and at least a portion of said at least one liquid stream and form a combined stream;

(2) said heat exchange means is connected to said combining means to receive said combined stream and cool said combined stream to form a condensed combined stream;

(3) said first expansion means is connected to said heat exchange means to receive said condensed combined stream and expand said condensed combined stream to said lower pressure to form an expanded condensed combined stream, said first expansion means being further connected to said distillation column to supply said expanded condensed combined stream to said distillation column at said top feed position; and (4) said fourth expansion means is connected to said separating means to receive any remaining portion of said at least one liquid stream and expand said at least one liquid stream to said lower pressure to form said expanded liquid stream.

* * * * *